US009110398B2

(12) United States Patent
Woo

(10) Patent No.: US 9,110,398 B2
(45) Date of Patent: Aug. 18, 2015

(54) MULTI PASS TYPE COLOR IMAGE FORMING APPARATUS AND CONTROL METHOD THEREOF

(71) Applicant: SAMSUNG ELECTRONICS CO., LTD., Suwon-si (KR)

(72) Inventor: Sang Bum Woo, Suwon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 216 days.

(21) Appl. No.: 13/713,311

(22) Filed: Dec. 13, 2012

(65) Prior Publication Data

US 2013/0149015 A1 Jun. 13, 2013

(30) Foreign Application Priority Data

Dec. 13, 2011 (KR) ..... 10-2011-0133831

(51) Int. Cl.

| | |
|---|---|
| ***G03G 15/00*** | (2006.01) |
| ***G03G 15/043*** | (2006.01) |
| ***G03G 15/01*** | (2006.01) |

(52) U.S. Cl.

CPC ..... *G03G 15/043* (2013.01); *G03G 15/0168* (2013.01); *G03G 15/5054* (2013.01); *G03G 2215/0158* (2013.01)

(58) Field of Classification Search

CPC ..... G03G 2215/0158; G03G 2215/0161; G03G 15/043; G03G 15/5054

USPC ..... 399/49, 301

See application file for complete search history.

(56) References Cited

U.S. PATENT DOCUMENTS

2005/0053389 A1 * 3/2005 Tanaka et al. ..... 399/66

FOREIGN PATENT DOCUMENTS

| | | |
|---|---|---|
| JP | 2004-220007 | 8/2004 |
| JP | 2005-10701 | 1/2005 |
| JP | 2011-81270 | 4/2011 |

* cited by examiner

*Primary Examiner* — David Bolduc
*Assistant Examiner* — Barnabas Fekete
(74) *Attorney, Agent, or Firm* — Staas & Halsey LLP

(57) ABSTRACT

A multi pass type color image forming apparatus and control method are provided. The apparatus advances an exposure time point of forming electrostatic latent images of second and subsequent colors more than that of a first color of a page during consecutive printing or reduces the velocity of a motor to rotate an intermediate transfer belt to minimize a color registration error between a developing agent image of the first color and developing agent images of the subsequent colors of the page caused by cleaning of the intermediate transfer belt and a control method thereof.

13 Claims, 21 Drawing Sheets

$c = \tan \theta$

MULTI PASS TYPE COLOR IMAGE FORMING APPARATUS AND CONTROL METHOD THEREOF

CROSS-REFERENCE TO RELATED APPLICATIONS

This application is related to, and claims priority to Korean Patent Application No. 10-2011-0133831, filed on Dec. 13, 2011 in the Korean Intellectual Property Office, the disclosure of which is incorporated herein by reference.

BACKGROUND

1. Field

Embodiments of the present invention relate to a multi pass type color image forming apparatus that forms an image based on a position of an intermediate transfer belt and a control method thereof.

2. Description of the Related Art

A color image forming apparatus may be classified as a multi pass type color image forming apparatus that rotates a photoconductor several times to form a color image or a single pass type color image forming apparatus that rotates a plurality of photoconductors once to form a color image.

The multi pass type color image forming apparatus generally includes an intermediate transfer belt that overlaps color developing agent images formed on the photoconductor to form a primary transfer image and secondarily transfers the primary transfer image to print media.

The developing agent images may be separately formed on the photoconductor by corresponding developers and then transferred to the intermediate transfer belt in an overlapping fashion. In order to obtain a uniform primary transfer image having no color registration error between the respective color developing agent images when the color developing agent images formed on the photoconductor are transferred to the intermediate transfer belt in an overlapping fashion, therefore, it may be necessary to transfer the respective color developing agent images to the same position of the intermediate transfer belt.

Conventionally, a position recognition hole indicating a home may be formed at the intermediate transfer belt, and the position recognition hole is sensed by a sensor so that the sensed result is used as a criterion to form an image on the photoconductor. That is, exposure time points of the respective colors are decided based on the home to align color front ends.

During consecutive printing of several pages in the multi pass type color image forming apparatus, an image primarily transferred to the intermediate transfer belt is secondarily transferred to paper, and then image wastes are removed from the intermediate transfer belt before next page printing so that the next page image is transferred to the intermediate transfer belt. A cleaning blade contacts the intermediate transfer belt to remove image wastes from the intermediate transfer belt.

During cleaning of the intermediate transfer belt, a load of, for example, 5 to 20 N is applied to the intermediate transfer belt. This load changes the position of the intermediate transfer belt. As a result, a color registration error may be generated.

When a page is printed, and the position recognition hole is sensed to print the next page, an exposure unit and developers are controlled to form a first color developing agent image, e.g. a yellow developing agent image, on the photoconductor and to transfer the developing agent image to the intermediate transfer belt. When the position recognition hole is sensed at this time, the yellow developing agent image is formed on the photoconductor and, at the same time, the cleaning blade, which is in contact with the intermediate transfer belt to clean the intermediate transfer belt, is separated from the intermediate transfer belt to finish cleaning.

Whenever the position recognition hole is sensed, other color developing agent images are formed on the photoconductor, and the developing agent images are transferred to the intermediate transfer belt, to which the yellow developing agent image has already been transferred, in an overlapping fashion.

However, when the first color developing agent image, e.g. the yellow developing agent image, is formed, the cleaning blade is not completely separated from the intermediate transfer belt unlike the other color developing agent images. Thus, the rotational velocity of the intermediate transfer belt is decreased due to friction caused by contact with the cleaning blade. As a result, a color registration error between the respective color developing agent images transferred to the intermediate transfer belt is generated. That is, yellow developing agent image transferred to the intermediate transfer belt is not aligned with magenta, cyan, and black developing agent images transferred to the intermediate transfer belt.

SUMMARY

It is an aspect of an embodiment of the present invention to provide a multi pass type color image forming apparatus that minimizes a color registration error between a developing agent image of a first color and developing agent images of a subsequent colors of a page caused by the change in rotational velocity of an intermediate transfer belt due to contact with a cleaning unit and a control method thereof.

Additional aspects of the invention will be set forth in part in the description which follows and, in part, will be obvious from the description, or may be learned by practice of the invention.

In accordance with an aspect of the present invention, a multi pass type color image forming apparatus includes a photoconductor, an exposure unit to irradiate a surface of the photoconductor to form an electrostatic latent image on the photoconductor, a plurality of developers to develop the electrostatic latent image formed on the photoconductor to form developing agent images on the photoconductor, an intermediate transfer belt to which the developing agent images formed on the photoconductor are transferred, a cleaning unit to come into contact with the intermediate transfer belt to remove developing agent wastes, a position recognition part formed on the intermediate transfer belt, a position sensing unit to sense the position recognition part, and a controller to control the exposure unit based on a sensing signal generated when the position sensing unit senses the position recognition part, wherein the controller controls an exposure time point of second and subsequent colors to be earlier than that of a first color to correct a color registration error between a developing agent image of the first color and developing agent images of the subsequent colors of a page caused by the change in rotational velocity of the intermediate transfer belt due to contact with the cleaning unit.

The controller may control the exposure time point of the second and subsequent colors to be earlier in time corresponding to a value of A+(B/2) than that of the first color according to Equation 1 and Equation 2:

$$A=c*(T_T1/Tr)*(T_Y_i-Tr) \quad \text{Equation 1}$$

$$B=c*(T_Y_i-Tr) \quad \text{Equation 2}$$

where, A is a front end color registration error of a page, B is a maximum color registration error of a page, T_Y_i is one rotation time of the intermediate transfer belt in an exposure section of a first color of an i-th page, T_T1 is time taken for the position recognition part to reach a first transfer roller via the position sensing unit, c is tan θ assuming that an angle between a value of A+B and a value of T_Y_i−Tr is θ, and Tr is an average value of one rotation time of the intermediate transfer belt in a warm-up section.

The controller may control the exposure time point of the second and subsequent colors to be earlier by dots equivalent to time corresponding to A+(B/2) than that of the first color.

The controller may control the exposure time point of the second and subsequent colors to be earlier than that of the first color from a second page during consecutive printing of a plurality of pages.

If one rotation time of the intermediate transfer belt rotated in the exposure section of the first color is greater than reference time, the controller may control the exposure time point of the second and subsequent colors to be earlier than that of the first color.

The reference time may be an average value of one rotation time of the intermediate transfer belt in a warm-up section.

In accordance with an aspect of the present invention, a control method of a multi pass type color image forming apparatus including a photoconductor, an exposure unit to irradiate to a surface of the photoconductor to form an electrostatic latent image on the photoconductor, a plurality of developers to develop the electrostatic latent image formed on the photoconductor to form developing agent images on the photoconductor, an intermediate transfer belt to which the developing agent images formed on the photoconductor are transferred, a cleaning unit to come into contact with the intermediate transfer belt to remove developing agent wastes, a position recognition part formed on the intermediate transfer belt, a position sensing unit to sense the position recognition part, and a controller to control the exposure unit based on a sensing signal generated when the position sensing unit senses the position recognition part includes irradiating light to the photoconductor at a reference exposure time point to form an electrostatic latent image of a first color and irradiating light to the photoconductor in a state in which an exposure time point of second and subsequent colors is controlled to be earlier than the reference exposure time point to correct a color registration error between a developing agent image of the first color and developing agent images of the subsequent colors of a page caused by the change in rotational velocity of the intermediate transfer belt due to contact with the cleaning unit.

The control method may include controlling the exposure time point of the second and subsequent colors earlier corresponding to a value of A+(B/2) than that of the first color according to Equation 1 and Equation 2:

$$A=c*(T_T1/Tr)*(T_Y_i-Tr) \quad \text{Equation 1}$$

$$B=c*(T_Y_i-Tr) \quad \text{Equation 2}$$

where, A is a front end color registration error of a page, B is a maximum color registration error of a page, T_Y_i is one rotation time of the intermediate transfer belt in an exposure section of a first color of an i-th page, T_T1 is time taken for the position recognition part to reach a first transfer roller via the position sensing unit, c is tan θ assuming that an angle between a value of A+B and a value of T_Y_i−Tr is θ, and Tr is an average value of one rotation time of the intermediate transfer belt in a warm-up section.

The control method may include controlling the exposure time point of the second and subsequent colors to be earlier by dots equivalent to time corresponding to A+(B/2) than that of the first color.

The control method may include controlling the exposure time point of the second and subsequent colors to be earlier than that of the first color from a second page during consecutive printing of a plurality of pages.

The control method may include, if one rotation time of the intermediate transfer belt rotated in the exposure section of the first color is greater than reference time, controlling the exposure time point of the second and subsequent colors to be earlier than that of the first color.

The reference time may be an average value of one rotation time of the intermediate transfer belt in a warm-up section.

In accordance with an aspect of the present invention, a multi pass type color image forming apparatus includes a photoconductor, an exposure unit to irradiate to a surface of the photoconductor to form an electrostatic latent image on the photoconductor, a plurality of developers to develop the electrostatic latent image formed on the photoconductor to form developing agent images on the photoconductor, an intermediate transfer belt to which the developing agent images formed on the photoconductor are transferred, a cleaning unit to come into contact with the intermediate transfer belt to remove developing agent wastes, a position recognition part formed on the intermediate transfer belt, a position sensing unit to sense the position recognition part, a motor to rotate the intermediate transfer belt, and a controller to control the exposure unit based on a sensing signal generated when the position sensing unit senses the position recognition part, wherein the controller controls velocity of the motor in an exposure section of second and subsequent colors to be lower than reference velocity of the motor in an exposure section of a first color to correct a color registration error between a developing agent image of the first color and developing agent images of the subsequent colors of a page caused by the change in rotational velocity of the intermediate transfer belt due to contact with the cleaning unit.

The controller may control the velocity of the motor in the exposure section of the second and subsequent colors to be reduced to velocity corresponding to Vm*(Tr/T_Y_i), where Vm is reference velocity of the motor, T_Y_i is one rotation time of the intermediate transfer belt in an exposure section of a first color of an i-th page, and Tr is an average value of one rotation time of the intermediate transfer belt in a warm-up section.

The controller may control the velocity of the motor in the exposure section of the second and subsequent colors to be lower than the reference velocity of the motor in the exposure section of the first color from a second page during consecutive printing of a plurality of pages.

If one rotation time of the intermediate transfer belt rotated in the exposure section of the first color is greater than reference time, the controller may control the velocity of the motor in the exposure section of the second and subsequent colors to be lower than the reference velocity of the motor in the exposure section of the first color.

The reference time may be an average value of one rotation time of the intermediate transfer belt in a warm-up section.

The controller may control the velocity of the motor to be reduced when transfer of the developing agent image of the first color from the photoconductor to the intermediate transfer belt is completed.

The multi pass type color image forming apparatus may include a first transfer roller disposed between the intermediate transfer belt and the photoconductor to transfer the developing agent images formed on the photoconductor to the intermediate transfer belt, wherein, if a distance from an exposure position of the photoconductor to the first transfer roller is greater than a predetermined distance, the controller may control the velocity of the motor in the exposure section of the second color to be lower than the reference velocity of the motor in the exposure section of the first color and an exposure time point of the second color to be earlier in time corresponding to Tb*Vm*(1−Tr/T_Y_i)/2 than a reference exposure time point of the first color, where Tb is time corresponding to a difference between the distance from the exposure position of the photoconductor to the first transfer roller and the predetermined distance, Vm is reference velocity of the motor, T_Y_i is one rotation time of the intermediate transfer belt in an exposure section of a first color of an i-th page, and Tr is an average value of one rotation time of the intermediate transfer belt in a warm-up section.

In accordance with an aspect of the present invention, a multi pass type color image forming apparatus includes a photoconductor, an exposure unit to irradiate to a surface of the photoconductor to form an electrostatic latent image on the photoconductor, a plurality of developers to develop the electrostatic latent image formed on the photoconductor to form developing agent images on the photoconductor, an intermediate transfer belt to which the developing agent images formed on the photoconductor are transferred, a cleaning unit to come into contact with the intermediate transfer belt to remove developing agent wastes, a first position recognition part formed at a front end of the intermediate transfer belt in a running direction of the intermediate transfer belt and a second position recognition part disposed at a rear end of the intermediate transfer belt, the first position recognition part and the second position recognition part being spaced apart from each other by a predetermined distance in a longitudinal direction of the intermediate transfer belt, a position sensing unit to sense the first position recognition part and the second position recognition part, a motor to rotate the intermediate transfer belt, and a controller to control the exposure unit based on a sensing signal generated when the position sensing unit senses the first position recognition part and velocity of the motor based on a sensing signal generated when the position sensing unit senses the second position recognition part, wherein the controller controls the velocity of the motor in an exposure section of second and subsequent colors to be lower than reference velocity of the motor in an exposure section of a first color to correct a color registration error between a developing agent image of the first color and developing agent images of the subsequent colors of a page caused by the change in rotational velocity of the intermediate transfer belt due to contact with the cleaning unit.

The controller may control the velocity of the motor in the exposure section of the second and subsequent colors to be reduced to velocity corresponding to Vm*(Tr/T_Y_i), where Vm is reference velocity of the motor, T_Y_i is one rotation time of the intermediate transfer belt in an exposure section of a first color of an i-th page, and Tr is an average value of one rotation time of the intermediate transfer belt in a warm-up section.

The controller may control the velocity of the motor in the exposure section of the second and subsequent colors to be lower than the reference velocity of the motor in the exposure section of the first color from a second page during consecutive printing of a plurality of pages.

If one rotation time of the intermediate transfer belt rotated in the exposure section of the first color is greater than reference time, the controller may control the velocity of the motor in the exposure section of the second and subsequent colors to be lower than the reference velocity of the motor in the exposure section of the first color.

The reference time may be an average value of one rotation time of the intermediate transfer belt in a warm-up section.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
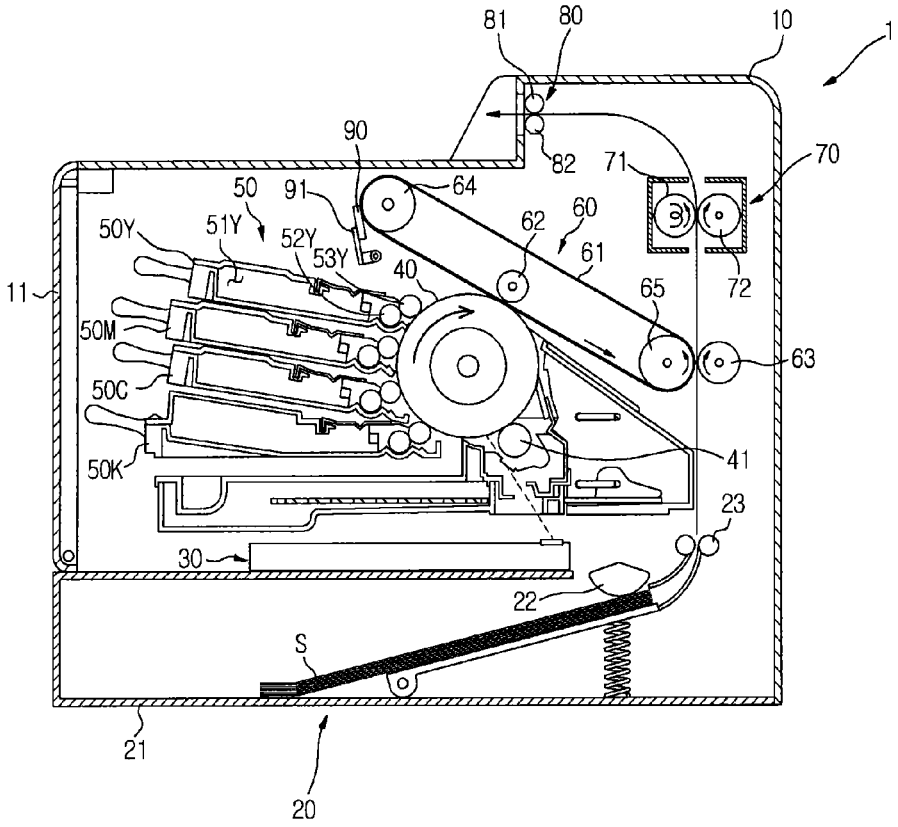
FIG. 1 illustrates a multi pass type color image forming apparatus according to an embodiment of the present invention.

Reference will now be made in detail to exemplary embodiments of the present invention, examples of which are illustrated in the accompanying drawings, wherein like reference numerals refer to like elements throughout.

FIG. 1 illustrates an image forming apparatus according to an embodiment of the present invention.

As illustrated in FIG. 1, an image forming apparatus 1 includes a main body 10, a print media supply unit 20, an exposure unit 30, a photoconductor 40, a developing unit 50, a transfer unit 60, a fusing unit 70, and a print media discharge unit 80.

The main body 10 may form the external appearance of the image forming apparatus 1 and supports various components installed therein. A main body cover 11 may be rotatably installed at a side of the main body 10. The main body cover 11 opens and closes a portion of the main body 10.

The print media supply unit 20 supplies print media S to the transfer unit 60. The print media supply unit 20 includes a cassette 21 in which print media S are stored, a pickup roller 22 to pick up the print media S stored in the cassette 21, and a feeding roller 23 to feed the picked-up print media S to the transfer unit 60.

The exposure unit 30 may be disposed under the developing unit 50 to irradiate light corresponding to image information to the photoconductor 40 so that an electrostatic latent image is formed on the surface of the photoconductor 40.

The photoconductor 40 may be configured by forming an optically conductive layer on the outer circumference of a cylindrical metal drum. The photoconductor 40 is an image carrier to carry an electrostatic latent image formed by the exposure unit 30 and developing agent images formed by the developing unit 50. The photoconductor 40 may be rotatably installed in the main body 10.

A charging roller 41 is installed in the main body 10. The charging roller 41 charges the photoconductor 40 with a predetermined potential before light is irradiated from the exposure unit 30. The charging roller 41 is an example of a charger to charge the photoconductor 40 with a uniform potential. The charging roller 41 supplies electric charges while rotating in contact or non-contact with the outer circumference of the photoconductor 40 to charge the outer circumference of the photoconductor 40 with uniform potential. Instead of the charging roller 41, a corona discharger may be adopted as the charger.

The developing unit 50 supplies a developing agent to the photoconductor 40 having the electrostatic latent image formed thereon to form developing agent images. The developing unit 50 includes four developers 50Y, 50M, 50C, and 50K to store different color developing agents, such as yellow (Y), magenta (M), cyan (C), and black (K) developing agents, respectively.

The developers 50Y, 50M, 50C, and 50K have developing agent storage units 51Y, 51M, 51C, and 51K, supply rollers 52Y, 52M, 52C, and 52K, and developing rollers 53Y, 53M, 53C, and 53K, respectively. The developing agent storage units 51Y, 51M, 51C, and 51K store developing agents to be supplied to the photoconductor 40. The supply rollers 52Y, 52M, 52C, and 52K supply the developing agents stored in the developing agent storage units 51Y, 51M, 51C, and 51K to the developing rollers 53Y, 53M, 53C, and 53K, respectively. The developing rollers 53Y, 53M, 53C, and 53K attach the developing agents to the surface of the photoconductor 40 at which the electrostatic latent image is formed to form developing agent images.

The transfer unit 60 includes an intermediate transfer belt 61, a first transfer roller 62, and a second transfer roller 63.

The intermediate transfer belt 61 is an image carrier to carry the developing agent images formed by the developing unit 50. The intermediate transfer belt 61 may be supported by a driven roller 64 and a driving roller 65 and runs at the same velocity as linear velocity of the photoconductor 40. The length of the intermediate transfer belt 61 may be equal to, or greater than, that of maximum-sized print media S used in the image forming apparatus.

The first transfer roller 62 may be opposite to the photoconductor 40 where the intermediate transfer belt 61 may be disposed between the first transfer roller 62 and the photoconductor 40 to transfer the developing agent images formed on the photoconductor 40 to the intermediate transfer belt 61. A first transfer bias voltage to transfer the developing agent images formed on the photoconductor 40 to the intermediate transfer belt 61 may be applied to the first transfer roller 62. The first transfer bias voltage has a polarity opposite to that of the developing agents. When the first transfer bias voltage is applied to the first transfer roller 62, the developing agent images formed on the surface of the photoconductor 40 are transferred to the intermediate transfer belt 61 in an overlapping fashion to form a primary transfer image.

The second transfer roller 63 may be opposite to the driving roller 65 where the intermediate transfer belt 61 may be disposed between the second transfer roller 63 and the driving roller 65. The second transfer roller 63 is spaced apart from the intermediate transfer belt 61 while the images from the photoconductor 40 are transferred to the intermediate transfer belt 61. The second transfer roller 63 comes into contact with the intermediate transfer belt 61 at predetermined pressure when transfer of the images from the photoconductor 40 to the intermediate transfer belt 61 is completed. When the second transfer roller 63 contacts the intermediate transfer belt 61, the images from the intermediate transfer belt 61 are transferred to print media S. A second transfer bias voltage to transfer the developing agent images to the print media S is applied to the second transfer roller 63. The second transfer bias voltage has a polarity opposite to that of the developing agents. When the second transfer bias voltage is applied to the second transfer roller 63, the primary transfer image formed on the intermediate transfer belt 61 may be transferred to print media S fed by the print media supply unit 20 as a secondary transfer image.

The fusing unit 70 includes a heating roller 71 having a heat source and a pressing roller 72 opposite to the heating roller 71. When print media S pass between the heating roller 71 and the pressing roller 72, the image is fixed to the print media S by heat from the heating roller 71 and pressure between the heating roller 71 and the pressing roller 72.

The print media discharge unit 80, including a discharging roller 81 and a discharging backup roller 82, discharges the print media S, having passed through the fusing unit 70, out of the main body 10.

The image forming apparatus 1 includes a cleaning unit 90 disposed in contact with the intermediate transfer belt 61 and a driving unit 91 to rotate the cleaning unit 90.

The cleaning unit 90 includes a cleaning blade, an end of which rubs against the intermediate transfer belt 61 to scratch developing agent wastes off the surface of the intermediate transfer belt 61. A brush type cleaning unit or a roller type cleaning unit may be used as the cleaning unit 90.

The driving unit 91 rotates the cleaning unit 90 about a rotary shaft thereof to separate the cleaning unit 90 from the intermediate transfer belt 61.

An operation of the multi pass type color image forming apparatus is disclosed.

When a printing operation commences, the surface of the photoconductor 40 is uniformly charged by the charging roller 41. The exposure unit 30 irradiates light corresponding to image information of a color, e.g. yellow, to the uniformly charged surface of the photoconductor 40.

An electrostatic latent image corresponding to the yellow image may be formed on the photoconductor 40.

A developing bias is applied to the developing roller 53Y of the yellow developer 50Y. As a result, a yellow developing agent is attached to the electrostatic latent image, and a yellow developing agent image is formed on the photoconductor 40. The yellow developing agent image is transferred to the intermediate transfer belt 61 by the first transfer roller 62.

When transfer of the yellow image for one page is completed, the exposure unit 30 irradiates light corresponding to image information of another color, e.g. magenta, to the photoconductor 40 so that an electrostatic latent image corresponding to the magenta image is formed on the photoconductor 40. The magenta developer 50M supplies a magenta developing agent to the electrostatic latent image to form a magenta developing agent image. The magenta developing agent image formed on the photoconductor 40 is transferred to the intermediate transfer belt 61 by the first transfer roller 62. The magenta developing agent image overlaps on the yellow developing agent image which has been previously transferred.

The process is carried out with respect to cyan and black to form a color image including the yellow, magenta, cyan, and black images, which overlap one another, on the intermediate transfer belt 61. The color image may be transmitted to print media S passing between the intermediate transfer belt 61 and the second transfer roller 63. The print media S are discharged out of the main body 10 via the fusing unit 70 and the print media discharge unit 80.

Figure 2:
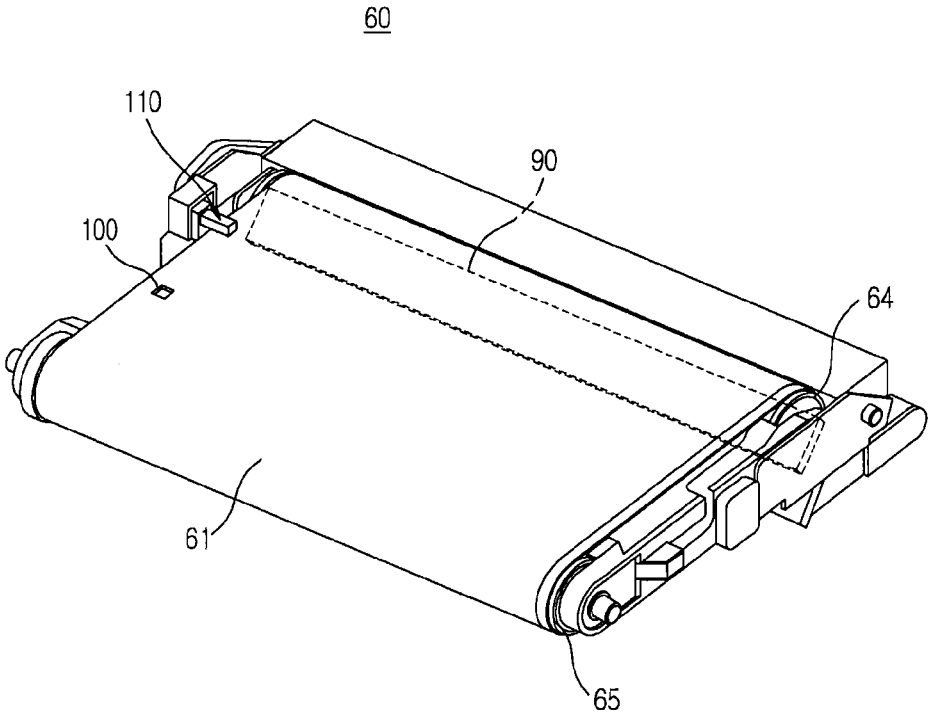
FIG. 2 illustrates a transfer unit of the multi pass type color image forming apparatus according to an embodiment of the present invention.
Figure 3:
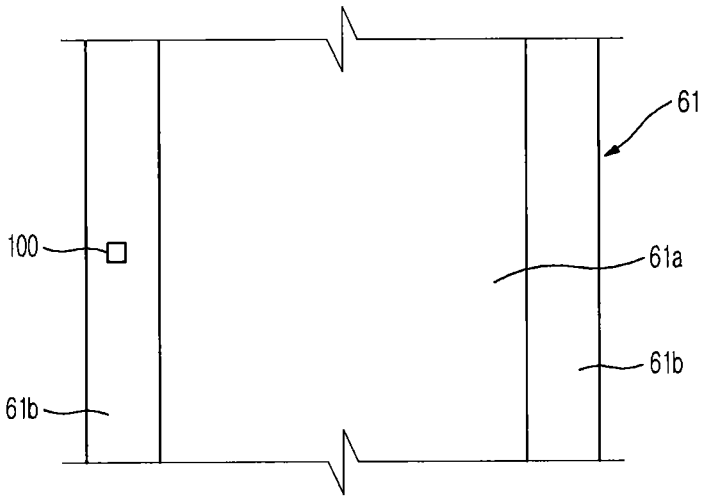
FIG. 3 illustrates a position recognition part provided at an intermediate transfer belt of the multi pass type color image forming apparatus according to an embodiment of the present invention.

FIG. 2 illustrates a transfer unit 60 FIG. 3 illustrates a position recognition part provided at an intermediate transfer belt.

As illustrated in FIG. 2, the intermediate transfer belt 61 may be rotatably supported by the driven roller 64 and the driving roller 65.

A position recognition part 100 may be formed at a side of the intermediate transfer belt 61. A position sensing unit 110 may be installed on a route along which the position recognition part 100 moves.

The position recognition part 100 ma be formed at the edge of one side of the intermediate transfer belt 61.

Figure 4:
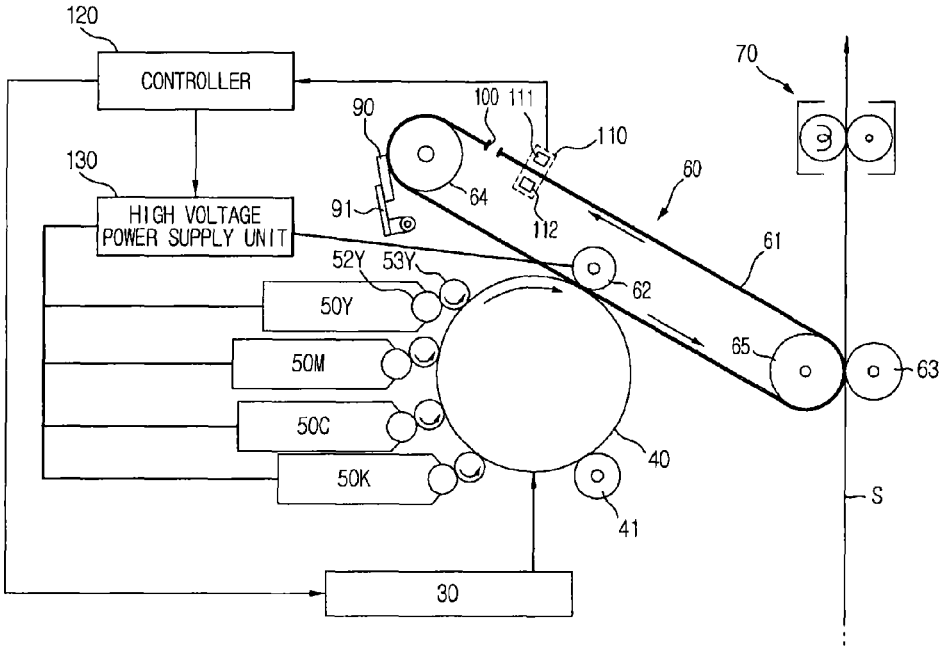
FIG. 4 illustrates an exposure time point of a first color, i.e. yellow, when a second page is printed after printing of a first page during consecutive printing of the multi pass type color image forming apparatus according to an embodiment of the present invention.

The position sensing unit 110 includes a position sensor, such as an optical sensor, having a light transmission part 111 and a light reception part 112 disposed on the route along which the position recognition part 100 moves in a state in which the position recognition part 100 may be disposed between the light transmission part 111 and the light reception part 112 to detect the position recognition part 100 passing through a place where the position sensing unit 110 is installed (see FIG. 4).

As illustrated in FIG. 3, the intermediate transfer belt 61 includes an optically conductive layer 61*a* exhibiting high transfer efficiency and protection layers 61*b* formed along opposite edges of the optically conductive layer 61*a*. A high-resistance coating layer having high volume resistance to prevent image blurring is formed at the outer surface of the optically conductive layer 61*a*.

The position recognition part 100 may be formed in the shape of a quadrangular slit or hole formed through a corresponding one of the protection layers 61*b*.

Figure 5:
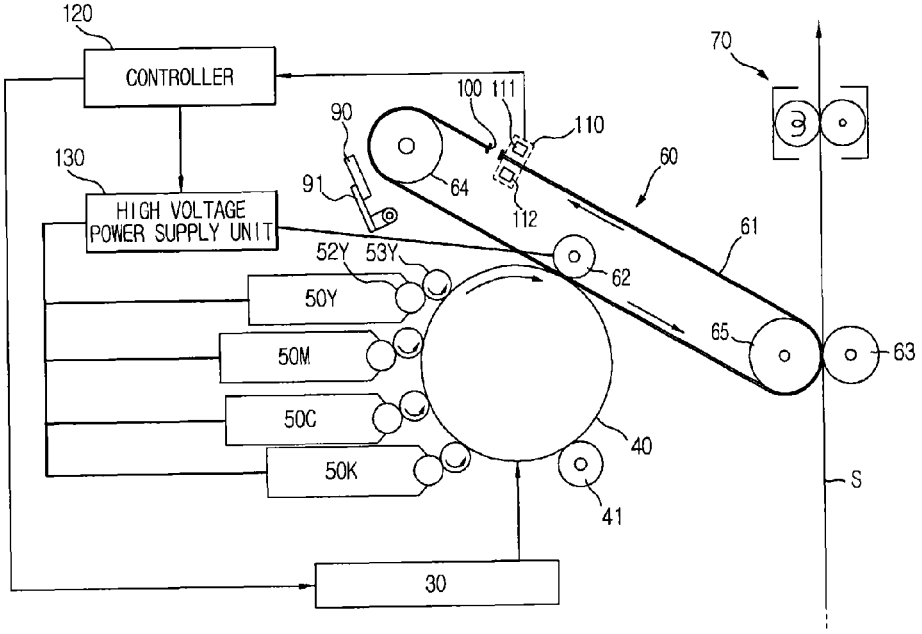
FIG. 5 illustrates an exposure time point of second and subsequent colors, i.e. magenta, cyan, and black, when a second page is printed after printing of a first page during consecutive printing of the multi pass type color image forming apparatus according to an embodiment of the present invention.

FIG. 4 illustrates an exposure time point of a first color, i.e. yellow, when a second page is printed after printing of a first page during consecutive printing of the multi pass type color image forming apparatus according to the embodiment of the present invention. FIG. 5 illustrates an exposure time point of second and subsequent colors, i.e. magenta, cyan, and black, when a second page is printed after printing of a first page during consecutive printing of the multi pass type color image forming apparatus according to the embodiment of the present invention.

As illustrated in FIGS. 4 and 5, the multi pass type color image forming apparatus includes a controller 120 and a high voltage power supply unit 130.

According to a control signal of the controller 120 to control overall operation of the image forming apparatus, the high voltage power supply unit 130 supplies developing bias voltage and supply bias voltage to the supply rollers 52Y, 52M, 52C, and 52K and the developing rollers 53Y, 53M, 53C, and 53K of the developers 50Y, 50M, 50C, and 50K, respectively. The high voltage power supply unit 130 supplies first transfer bias voltage to the first transfer roller 62 and second transfer bias voltage to the second transfer roller 63.

The controller 120 receives position information of the intermediate transfer belt 61 from the position sensing unit 110.

When printing of a page is completed and the position sensing unit 110 senses the position recognition part 100 to print the next page according to a printing command to consecutively print several pages, the controller 120 controls the exposure unit 30 and the developing unit 50 at a predetermined exposure time point based on the sensed time point to form a first color developing agent image, e.g. a yellow developing agent image, on the surface of the photoconductor 40 and to transfer the yellow developing agent image to the intermediate transfer belt 61. When the position recognition part 100 is sensed at this time, the yellow developing agent image is formed on the surface of the photoconductor 40 and, at the same time, the controller 120 controls the driving unit 91 to separate the cleaning unit 90, which is in contact with the intermediate transfer belt 61 to clean the intermediate transfer belt 61, from the intermediate transfer belt 61 to finish cleaning.

When the first color developing agent image, e.g. the yellow developing agent image, is formed, the cleaning unit 90 is not completely separated from the intermediate transfer belt 61 unlike the other color developing agent images. The rotational velocity of the intermediate transfer belt 61 is decreased due to friction caused by contact with the cleaning unit 90. As a result, a color registration error between the respective color developing agent images transferred to the intermediate transfer belt 61 is generated. That is, the yellow developing agent image transferred to the intermediate transfer belt 61 is not aligned with the magenta, cyan, and black developing agent images transferred to the intermediate transfer belt 61.

In the multi pass type color image forming apparatus according to an embodiment of the present invention, therefore, when the position sensing unit 110 senses the position recognition part 100 again after the yellow developing agent image is formed on the surface of the photoconductor 40 and a yellow developing agent image waste is removed from the intermediate transfer belt 61, the controller 120 controls the exposure unit 30 and the developing unit 50 at a earlier exposure time point than that when the yellow developing agent image is formed to form an electrostatic latent image on the photoconductor 40, to form developing agent images on the electrostatic latent image using the magenta, cyan, and black developers 50M, 50C, and 50K, and to transfer the developing agent images to the intermediate transfer belt 61 in an overlapping fashion, thereby correcting such a color registration error (see, for example, FIGS. 4 and 5).

The color registration error between the first color developing agent image, i.e. the yellow developing agent image, and the subsequent color developing agent images, i.e. the magenta, cyan, and black developing agent images, caused due to cleaning of the intermediate transfer belt 61 is reduced, thereby improving image precision.

A earlier exposure time point when second and subsequent color developing agent images, i.e. magenta, cyan, and black developing agent images, are formed than that when a first color developing agent image, e.g. a yellow developing agent image, is formed, thereby reducing a color registration error between the first developing agent image, i.e. the yellow developing agent image, and the subsequent color developing agent images, i.e. the magenta, cyan, and black developing agent images, caused due to cleaning of the intermediate transfer belt 61 is disclosed.

Figure 6A:
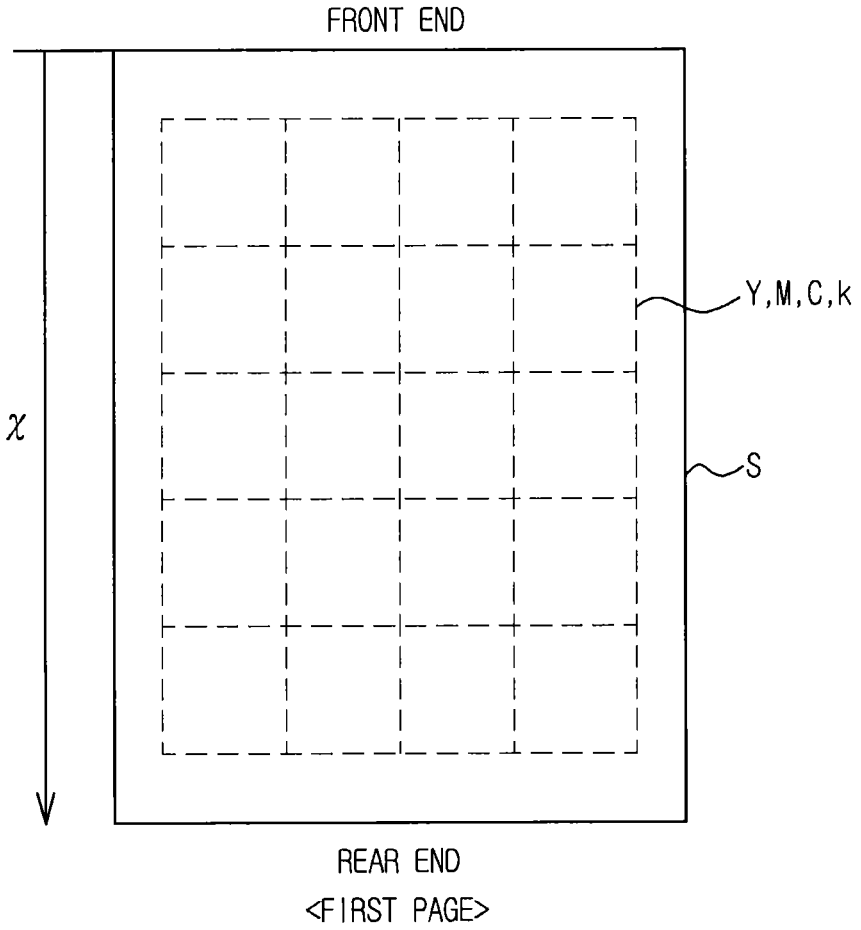
FIGS. 6A and 6B illustrate a color registration error according to cleaning of the intermediate transfer belt at a first page during consecutive printing of the multi pass type color image forming apparatus according to an embodiment of the present invention.
Figure 6B:
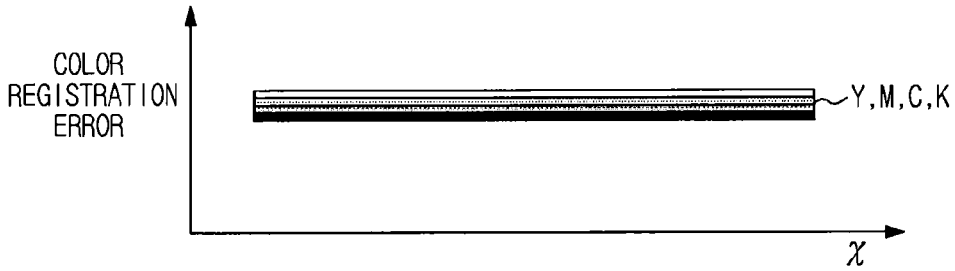
Figure 7A:
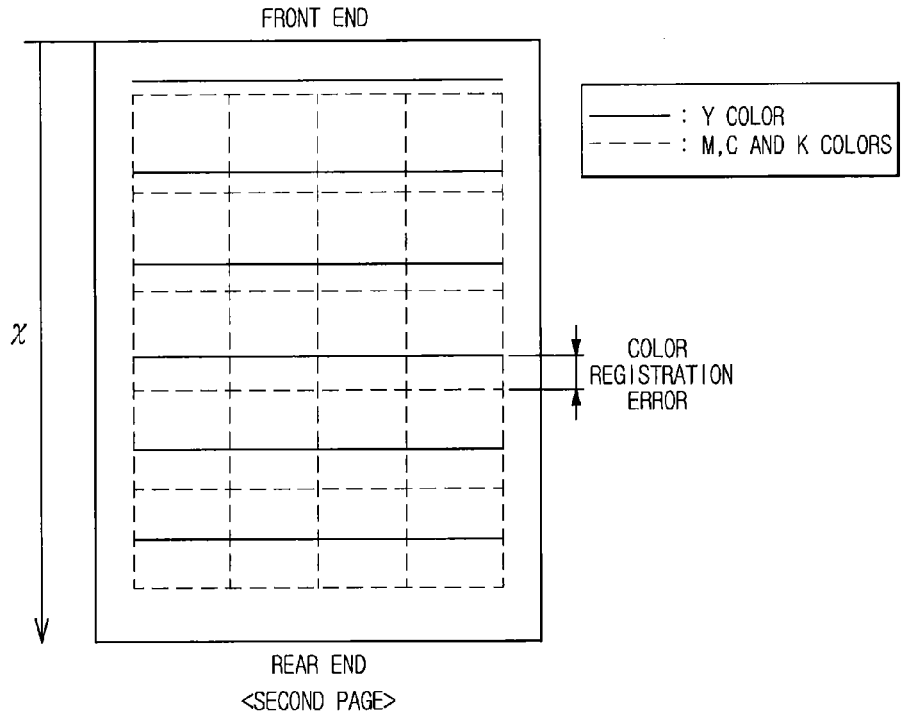
FIGS. 7A and 7B illustrate a color registration error according to cleaning of the intermediate transfer belt at a second page during consecutive printing of the multi pass type color image forming apparatus according to an embodiment of the present invention.
Figure 7B:
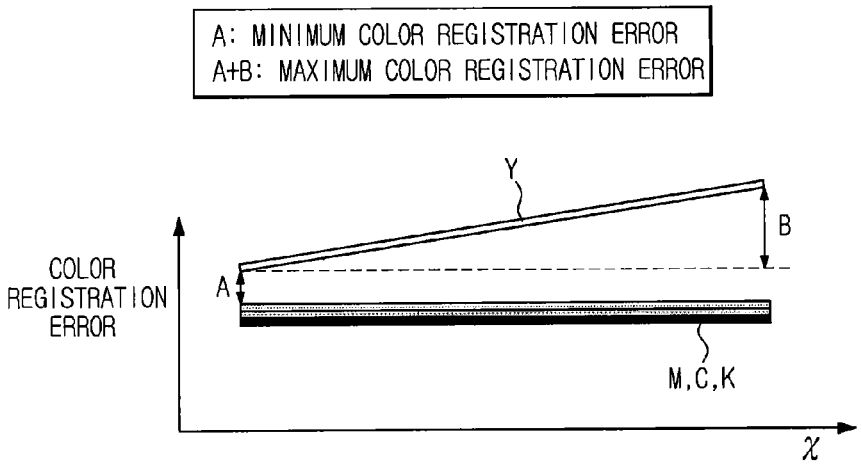

FIGS. 6A and 6B illustrate a color registration error according to cleaning of the intermediate transfer belt at a first page during consecutive printing of the multi pass type color image forming apparatus according to an embodiment of the present invention. FIGS. 7A and 7B illustrate a color registration error according to cleaning of the intermediate transfer belt at a second page during consecutive printing of the multi pass type color image forming apparatus according to the embodiment of the present invention.

As illustrated in FIGS. 6A and 6B, a color registration error between a first color developing agent image, e.g. a yellow (Y) developing agent image, and second and subsequent color developing agent images, i.e. magenta (M), cyan (C), and black (K) developing agent images, are minimal at a first page during consecutive printing.

As illustrated in FIGS. 7A and 7B, on the other hand, a color registration error between the first color developing agent image, e.g. the yellow (Y) developing agent image, and the second and subsequent color developing agent images, i.e. the magenta (M), cyan (C), and black (K) developing agent images, is generated at a second page during consecutive printing.

That is, an operation of removing an image waste from the intermediate transfer belt 61 is performed after the first page is output during consecutive printing. Such cleaning acts on the intermediate transfer belt 61 as a load. Load fluctuation changes velocity of the intermediate transfer belt 61. The change in velocity of the intermediate transfer belt 61 changes the position of an image transferred to the intermediate transfer belt 61. The change in position of the image transferred to the intermediate transfer belt 61 change an image transferred to print media S.

In FIGS. 7A and 7B, a value of "x" indicates a position from a front end of print media S.

A color registration error may be gradually increased from the front end to the rear end of the print media S.

Figure 8A:
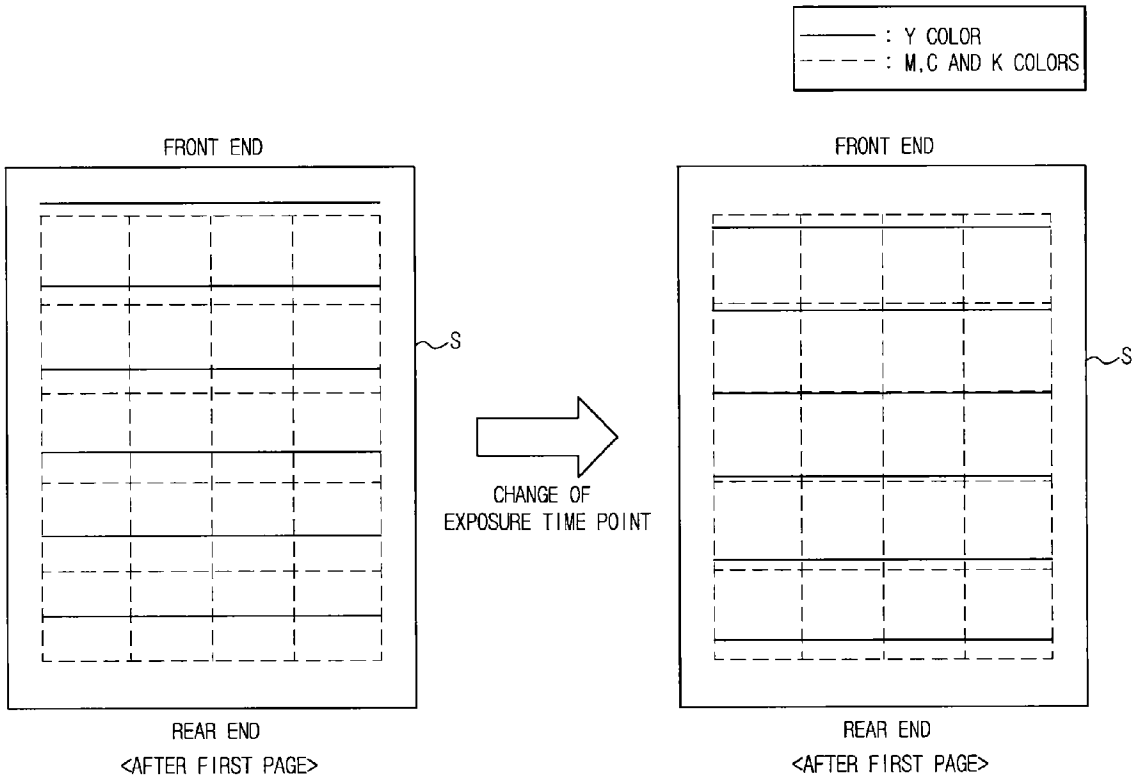
FIGS. 8A and 8B illustrate correction of a color registration error between a first color and subsequent colors at the second page during consecutive printing of the multi pass type color image forming apparatus according to an embodiment of the present invention.
Figure 8B:
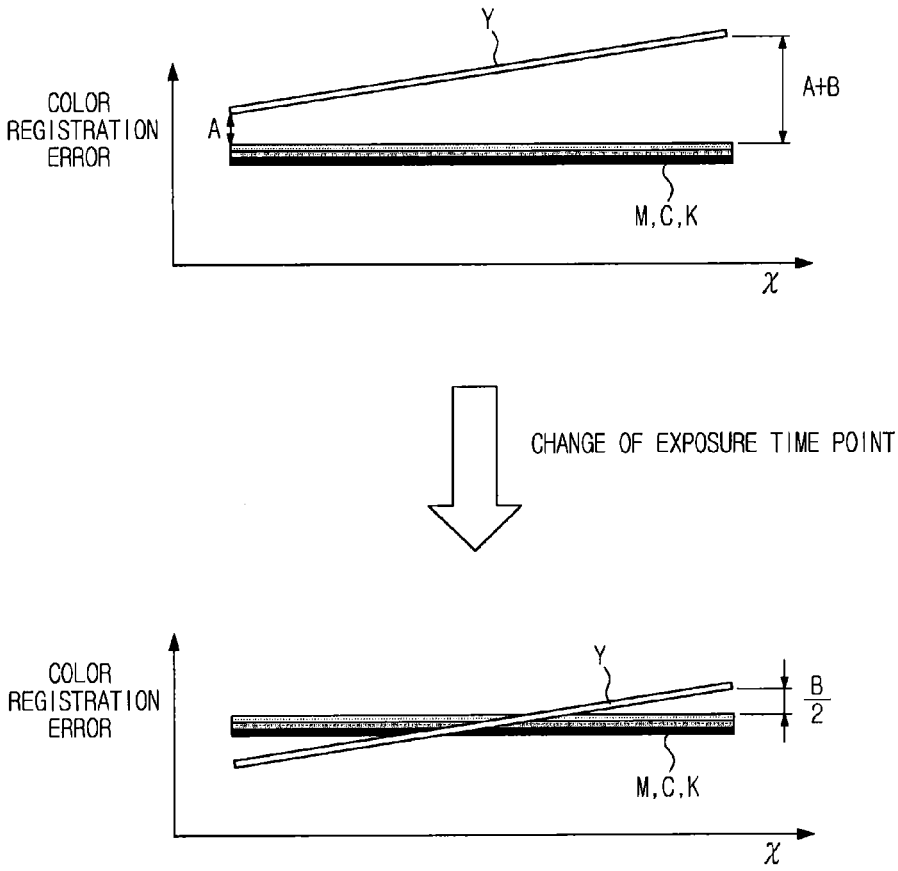

Assuming that a front end color registration error between a Y color and M, C, and K colors is A, and the maximum color registration error is A+B, the color registration error A is generated at the front end of the print media S, and the color registration error A+B is generated toward the rear end of the print media S FIGS. 8A and 8B illustrate correction of a color registration error between a first color and subsequent colors at the second page during consecutive printing of the multi pass type color image forming apparatus according to an embodiment of the present invention.

As illustrated in FIGS. 8A and 8B, an exposure time point of M, C, and K colors may be changed to reduce a color registration error. That is, the maximum color registration error may be reduced from A+B to B/2.

Figure 9:
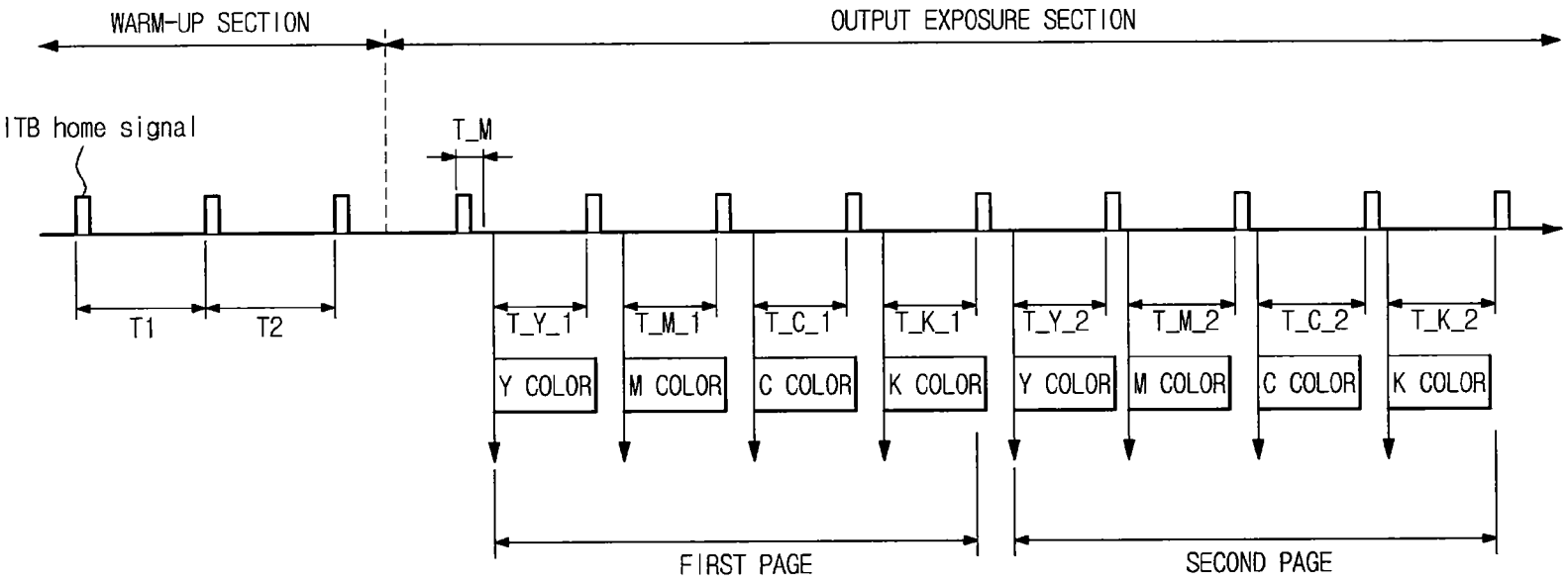
FIG. 9 illustrates a time table for image output during consecutive printing of the multi pass type color image forming apparatus according to an embodiment of the present invention.

FIG. 9 illustrates a time for image output during consecutive printing of the multi pass type color image forming apparatus according to the embodiment of the present invention.

As illustrated in FIG. 9, a warm-up section may be provided to check a status of the respective components and heat the fusing unit before exposure for image output.

In the warm-up section, the intermediate transfer belt 61 is idled. Before exposure for image output, therefore, time taken for one rotation of the intermediate transfer belt 61 may be measured using a sensing signal (ITB home signal) generated whenever the position recognition part 100 of the intermediate transfer belt 61 passes through the position sensing unit 110.

The measured values are T1 and T2, and an average value Tr thereof is stored in a memory.

The average value Tr indicates a representative value of time taken for one rotation of the intermediate transfer belt 61. Image forming apparatuses may have different average values Tr due to tolerance of the length of the intermediate transfer belt 61 and the diameter of the driving roller 65.

In FIG. 9, time T_Y_1 and T_Y_2 may be measured immediately before magenta exposure of each page for image output. Assuming that one rotation time of the intermediate transfer belt 61 in an exposure section of a first color of an i-th page is T_Y_i, T_Y_i has a value different from Tr.

A time difference between T_Y_i and Tr, i.e. T_Y_i−Tr, indicates time difference based on reference time. When a cleaning load is absent, the time difference has a value of 0. In a case in which a cleaning load is present, the time difference has a positive (+) value.

In FIG. 7B, A and B values may be predicted when T_Y_i−Tr based on cleaning load is linearly approximated.

That is, A may be expressed by Equation 1 below, and B may be expressed by Equation 2:

$$A=c*(T_T1/Tr)*(T_Y_i-Tr) \quad \text{Equation 1}$$

$$B=c*(T_Y_i-Tr) \quad \text{Equation 2}$$

where, c is a coefficient value which may be obtained when T_Y_i−Tr based on cleaning load is linearized, and T_T1 is time taken for the position recognition part 100 to reach the first transfer roller 62 via the position sensing unit 110.

A+B may be expressed by Equation 3 as:

$$A+B=c*(T_Y_i-Tr) \quad \text{Equation 3}$$

Figure 10:
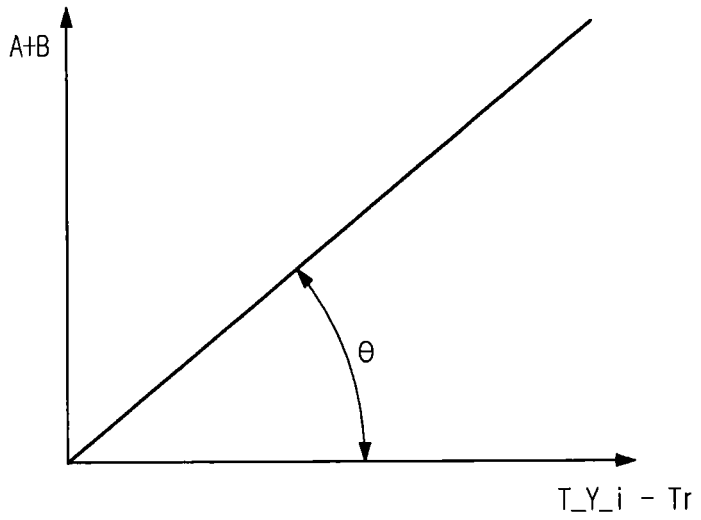
FIG. 10 illustrates a coefficient value when T_Y_i−Tr based on cleaning load is linearized in the multi pass type color image forming apparatus according to an embodiment of the present invention.

FIG. 10 illustrates a coefficient value when T_Y_i−Tr based on cleaning load is linearized in the multi pass type color image forming apparatus according to the embodiment of the present invention.

As illustrated in FIG. 10, c is a coefficient value which may be obtained when T_Y_i−Tr based on cleaning load is linearized. Assuming that an angle between A+B and T_Y_i−Tr is θ, c is tan θ.

As illustrated in FIG. 9, when a sensing signal (ITB home signal) generated when T_Y_i is measured, i.e. when the position recognition part 100, based on which magenta exposure is commenced, is sensed, is input, A and B may be calculated by equations 1 and 2, and c may be obtained using a method illustrated in FIG. 10.

An exposure time point of magenta, cyan, and black developing agent images may be changed to reduce the maximum color registration error.

The exposure time point may be changed or dots may be shifted by A+(B/2). That is, the exposure time point of the magenta, cyan, and black developing agent images may be advanced by A+(B/2) to reduce the color registration error in real time.

The exposure time point may be adjusted on a per dot basis. An adjustment amount may be decided by round(A+(B/2), 1 dot). Where, round(x, y) indicates a value obtained by rounding a value of x/y.

Figure 11:
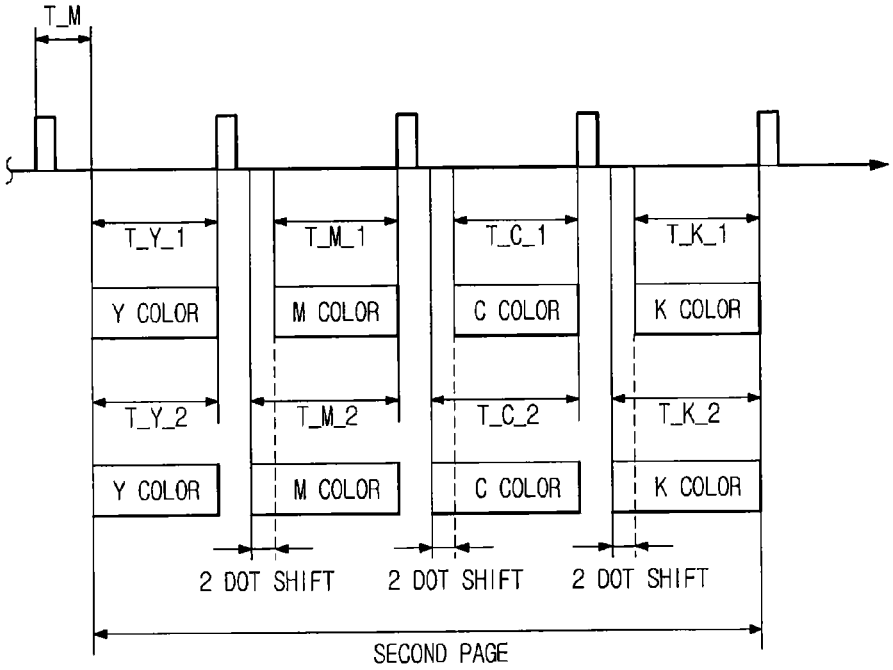
FIG. 11 illustrates advancement of an exposure time point of M, C, and K colors as compared with that of a Y color during consecutive printing of the multi pass type color image forming apparatus according to an embodiment of the present invention.
Figure 12A:
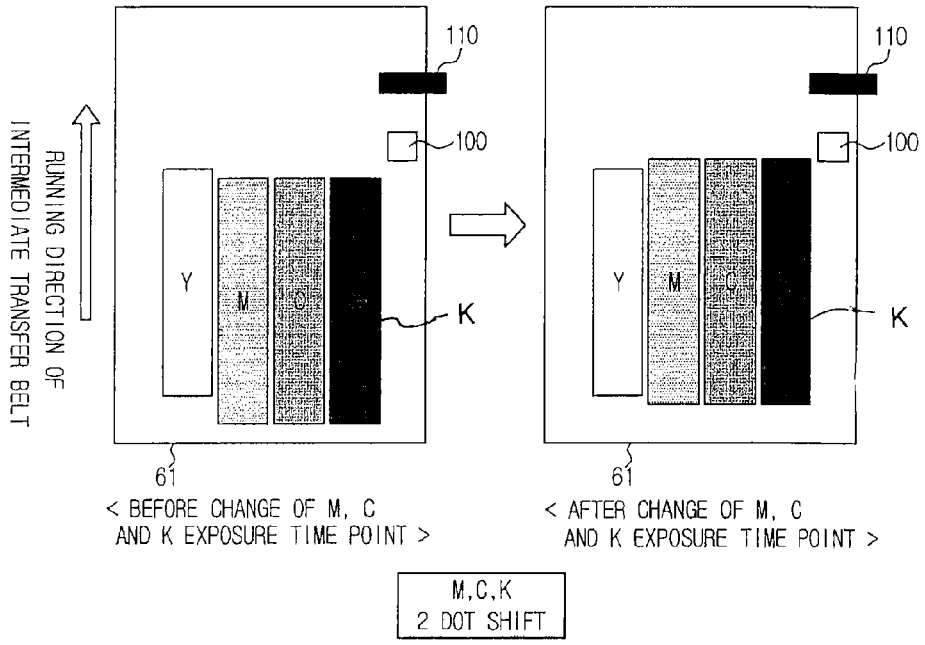
FIGS. 12A and 12B illustrate advancement of an exposure time point of the M, C, and K colors as compared with that of the Y color during consecutive printing of the multi pass type color image forming apparatus according to an embodiment of the present invention to reduce a color registration error.
Figure 12B:
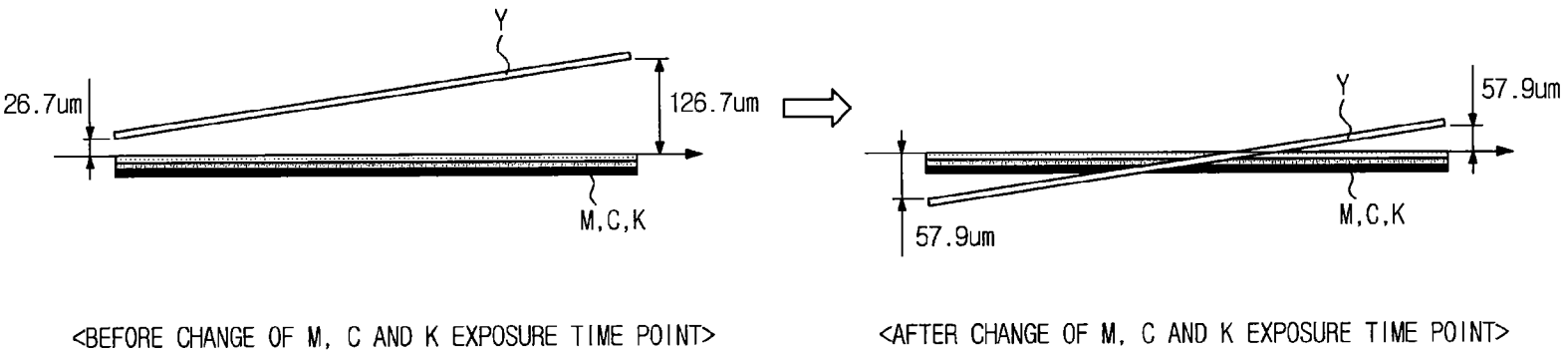

FIG. 11 illustrates an earlier exposure time point of M, C, and K colors as compared with that of a Y color during consecutive printing of the multi pass type color image forming apparatus according to an embodiment of the present invention. FIGS. 12A and 12B illustrate an earlier exposure time point of the M, C, and K colors as compared with that of the Y color during consecutive printing of the multi pass type color image forming apparatus according to an embodiment of the present invention to reduce a color registration error.

As illustrated in FIG. 11, assuming that c=10 um/ms, an average of T1 and T2=3750 ms, T_Y_1=3760 ms, and T_T1=1000 ms, A=26.7 um, and B=100 um according to equation 1 above. An exposure time point of magenta, cyan, and black may be advanced in time corresponding to A+(B/2), i.e. 76.7 um. The exposure time point may be adjusted on a per dot basis. The 76.7 um approximates to 2 dots. Consequently, the exposure time point may be advanced by 2 dots.

As illustrated in FIGS. 12A and 12B, if the exposure time point of the M, C, and K colors earlier in time corresponding to 2 dots (A+(B/2)=76.7 um) than that of the Y color, the maximum color registration error between the Y color and the M, C, and K colors may be reduced from 126.7 um(A+B) to 57.9 um(A+(B/2)).

To reduce the color registration error between the first color and the subsequent colors at the second page according to cleaning of the intermediate transfer belt after the first page is printed during consecutive printing of the multi pass type color image forming apparatus according to an embodiment of the present invention, the rotational velocity of the motor to drive the driving roller 65 rotating the intermediate transfer belt 61 in the exposure section of the M, C, and K colors may be changed instead of more advancing the exposure time point of the second and subsequent color developing agent images, i.e. the M, C, and K color developing agent images than that of the first color developing agent image, i.e. the Y color developing agent image.

That is, assuming that the rotational velocity of the motor to drive the driving roller 65 so that the intermediate transfer belt 61 has one rotation time of Tr is Vm, the motor velocity Vm is reduced to Vm*(Tr/T_Y_i) in the exposure section of magenta, cyan, and black to compensate the image length and DC offset due to cleaning load. The color registration error may be more effectively reduced. If T_Y_i is equal to Tr, the rotational velocity of the motor is Vm. If T_Y_i is greater than Tr, the rotational velocity of the motor is less than Vm. Vm is a reference belt velocity.

Figure 13A:
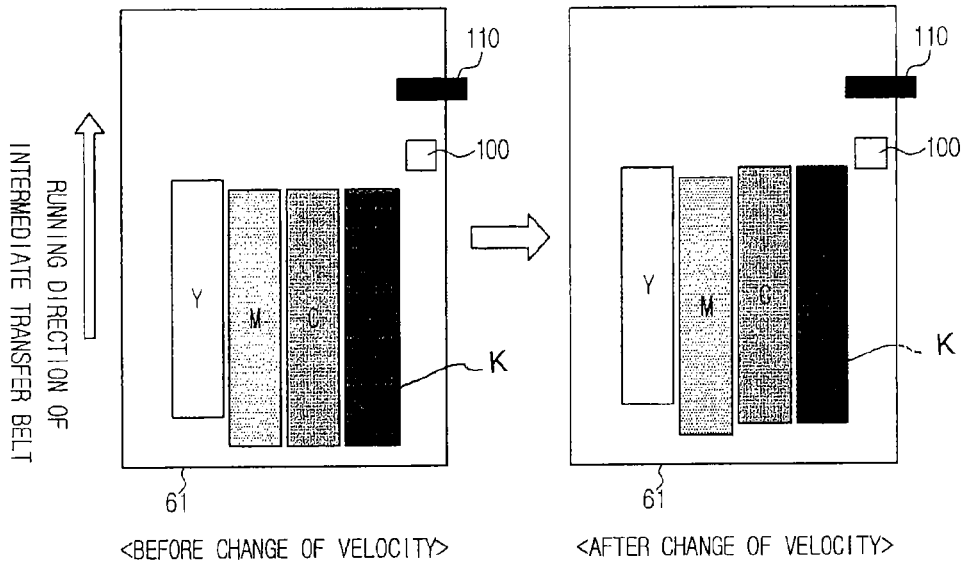
FIGS. 13A and 13B illustrate reduction of the rotational velocity of a motor to drive a driving roller to rotate the intermediate transfer belt at an exposure section of the M, C, and K colors as compared with the rotational velocity of the motor at an exposure section of the Y color during consecutive printing of the multi pass type color image forming apparatus according to an embodiment of the present invention to reduce a color registration error.
Figure 13B:
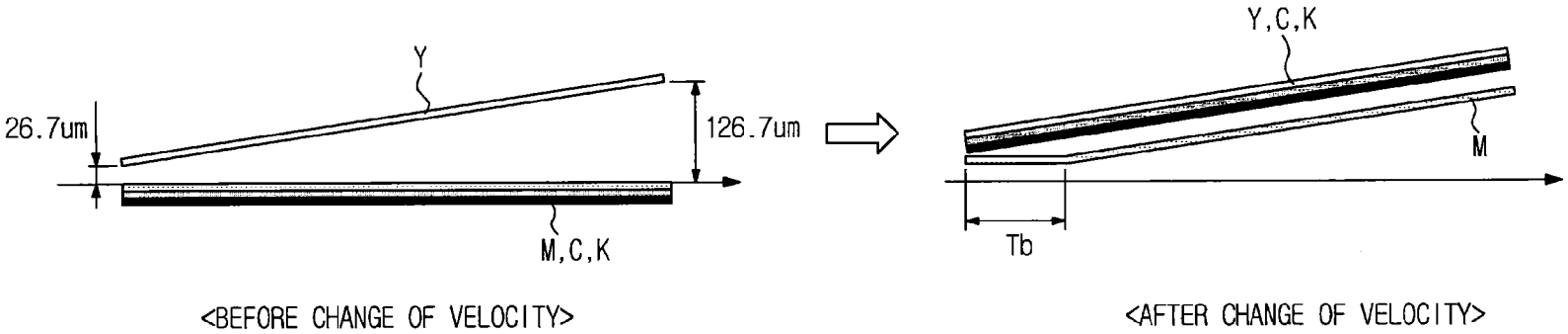

FIGS. 13A and 13B illustrate reduction of the rotational velocity of the motor to drive the driving roller to rotate the intermediate transfer belt at exposure section of the M, C, and K colors as compared with the rotational velocity of the motor at an exposure section of the Y color during consecutive printing of the multi pass type color image forming apparatus according to an embodiment of the present invention to reduce the color registration error.

As illustrated in FIGS. 13A and 13B, assuming that c=10 um/ms, an average of T1 and T2=3750 ms, T_Y_1=3760 ms, and T_T1=1000 ms, A=26.7 um, and B=100 um according to equation 1 above. The velocity of the intermediate transfer belt during transfer of the yellow color may approximate to Vm*(Tr/T_Y_i).

If the velocity of the intermediate transfer belt 61 is reduced to Vm*(Tr/T_Y_i) when the transfer of the yellow color to the intermediate transfer belt 61 is completed, the color registration error of three colors except magenta may be reduced as follows.

For the magenta color, velocity is not reduced during Tb, and therefore, the color registration error is generated.

Figure 14:
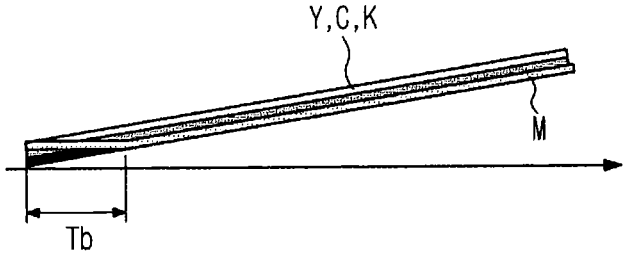
FIG. 14 illustrates reduction of the rotational velocity of the motor at the exposure section of the M, C, and K colors as compared with the rotational velocity of the motor at the exposure section of the Y color and advancement of the exposure time point of the M color as compared with that of the other colors during consecutive printing of the multi pass type color image forming apparatus according to an embodiment of the present invention to reduce a color registration error.

Tb is a time corresponding to the difference between a distance from an exposure position of the photoconductor 40 to the first transfer roller 62 and a predetermined distance. If the distance from the exposure position of the photoconductor 40 to the first transfer roller 62 is greater than the predetermined distance, Tb has a positive (+) value. If the distance from the exposure position of the photoconductor 40 to the first transfer roller 62 is less than the predetermined distance, Tb may be removed. If Tb has a positive value, the exposure time point of the magenta color may be advanced by round (Tb*Vm*(1−Tr/T_Y_i)/2) to reduce the color registration error (see FIG. 14).

Figure 15A:
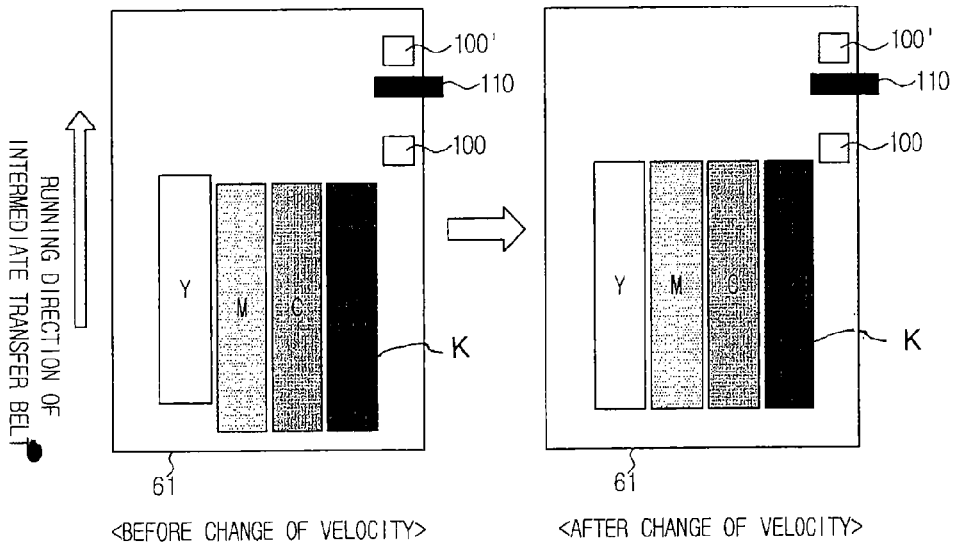
FIGS. 15A and 15B illustrate reduction of the rotational velocity of a motor at an exposure section of M, C, and K colors as compared with the rotational velocity of the motor at an exposure section of a Y color in a multi pass type color image forming apparatus according to an embodiment of the present invention to reduce a color registration error.
Figure 15B:
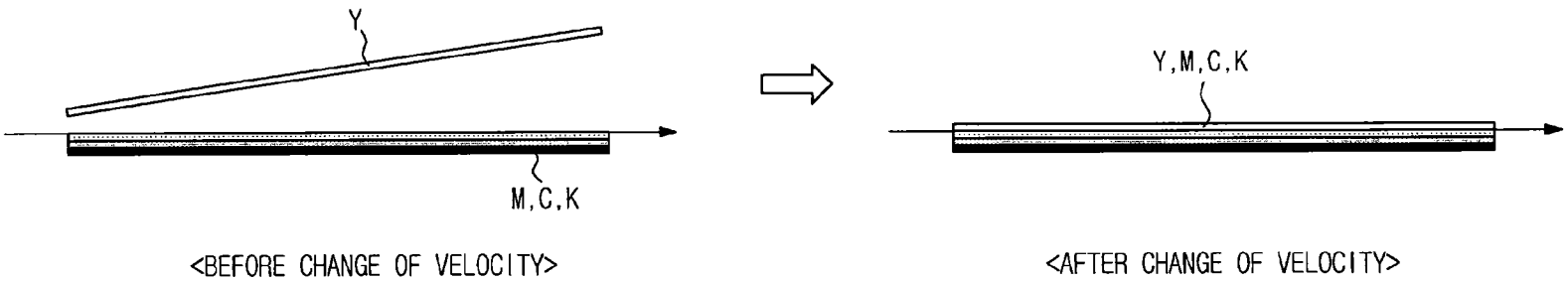

FIGS. 15A and 15B illustrate reduction of the rotational velocity of a motor at an exposure section of M, C, and K colors as compared with the rotational velocity of the motor at an exposure section of a Y color in a multi pass type color image forming apparatus according to another embodiment of the present invention to reduce a color registration error.

When the velocity of an intermediate transfer belt 61 is sensed to perform exposure in order of yellow, magenta, cyan, and black, as illustrated in FIG. 15A, a first position recognition part 100, based on which exposure is commenced, and a second position recognition part 100' located closer to the front end of the intermediate transfer belt 61 than the first position recognition part 100 are provided at the intermediate transfer belt 61, and the velocity of a motor in an exposure section of magenta, cyan, and black may be reduced based on when the second position recognition part 100' is sensed, thereby more effectively minimizing a color registration error.

The Tb section of FIG. 13B does not to be considered, and the color registration error may be more effectively minimized through control of the motor velocity without change of an exposure time point of magenta.

In accordance with an aspect of the present invention, an exposure time point of forming electrostatic latent images of second and subsequent colors is earlier than that of a first color of a page during consecutive printing or the velocity of the motor to rotate the intermediate transfer belt is reduced to minimize a color registration error between a developing agent image of the first color and developing agent images of the subsequent colors of the page caused by cleaning of the intermediate transfer belt. As a result, the color registration error between the color images is minimized without provision of an additional sensor, thereby improving image precision.

In accordance with an aspect of the present invention, no pattern is output to the intermediate transfer belt to minimize the color registration error between the color images, thereby improving image precision while preventing unnecessary toner consumption.

In accordance with an aspect of the present invention, no pattern is output to the intermediate transfer belt to minimize the color registration error between the color images, thereby improving image precision without increasing first print time out (FPOT).

Cleaning of the intermediate transfer belt acts on the intermediate transfer belt as load, which is related to the amount of toner used with respect to an image to be cleaned and is changed every output. Whenever pages are output, therefore, change amounts of the front end of a firstly transferred color and the length of an image are changed. In accordance with an aspect of the present invention, however, an ACR operation is performed whenever pages are output, thereby correcting distortion of the image caused by the change.

Although a few embodiments of the present invention have been illustrated and described, it would be appreciated by those skilled in the art that changes may be made in these embodiments without departing from the principles and spirit of the invention, the scope of which is defined in the claims and their equivalents.

What is claimed is:

1. A multi pass type color image forming apparatus comprising:

a photoconductor;

an exposure unit to irradiate to a surface of the photoconductor to form an electrostatic latent image on the photoconductor;

a plurality of developers to develop the electrostatic latent image formed on the photoconductor to form developing agent images on the photoconductor;

an intermediate transfer belt to which the developing agent images formed on the photoconductor are transferred;

a cleaning unit to come into contact with the intermediate transfer belt to remove developing agent wastes;

a position recognition part formed on the intermediate transfer belt;

a position sensing unit to sense the position recognition part;

a motor to rotate the intermediate transfer belt; and a controller to control the exposure unit based on a sensing signal generated when the position sensing unit senses the position recognition part, wherein the controller controls velocity of the motor in an exposure section of second and subsequent colors to be lower than reference velocity of the motor in an exposure section of a first color to correct a color registration error between a developing agent image of the first color and developing agent images of the subsequent colors of a page caused by a change in rotational velocity of the intermediate transfer belt due to contact with the cleaning unit.

2. The multi pass type color image forming apparatus according to claim 1, wherein the controller controls the velocity of the motor in the exposure section of the second and subsequent colors to be reduced to velocity corresponding to Vm*(Tr/T_Y_i), where Vm is reference velocity of the motor, T_Y_i is one rotation time of the intermediate transfer belt in an exposure section of a first color of an i-th page, and Tr is an average value of one rotation time of the intermediate transfer belt in a warm-up section.

3. The multi pass type color image forming apparatus according to claim 1, wherein the controller controls the velocity of the motor in the exposure section of the second and subsequent colors to be lower than the reference velocity of the motor in the exposure section of the first color from a second page during consecutive printing of a plurality of pages.

4. The multi pass type color image forming apparatus according to claim 1, wherein, if one rotation time of the intermediate transfer belt rotated in the exposure section of the first color is greater than reference time, the controller controls the velocity of the motor in the exposure section of the second and subsequent colors to be lower than the reference velocity of the motor in the exposure section of the first color.

5. The multi pass type color image forming apparatus according to claim 4, wherein the reference time is an average value of one rotation time of the intermediate transfer belt in a warm-up section.

6. The multi pass type color image forming apparatus according to claim 1, wherein the controller controls the velocity of the motor to be reduced when transfer of the developing agent image of the first color from the photoconductor to the intermediate transfer belt is completed.

7. The multi pass type color image forming apparatus according to claim 1, further comprising:

a first transfer roller disposed between the intermediate transfer belt and the photoconductor to transfer the developing agent images formed on the photoconductor to the intermediate transfer belt, wherein if a distance from an exposure position of the photoconductor to the first transfer roller is greater than a predetermined distance, the controller controls the velocity of the motor in the exposure section of the second color to be lower than the reference velocity of the motor in the exposure section of the first color and an exposure time point of the second color to be earlier in time corresponding to Tb*Vm*(1−Tr/T_Y_i)/2 than a reference exposure time point of the first color, where Tb is time corresponding to a difference between the distance from the exposure position of the photoconductor to the first transfer roller and the predetermined distance, Vm is reference velocity of the motor, T_Y_i is one rotation time of the intermediate transfer belt in an exposure section of a first color of an i-th page, and Tr is an average value of one rotation time of the intermediate transfer belt in a warm-up section.

8. A multi pass type color image forming apparatus comprising:

a photoconductor;

an exposure unit to irradiate to a surface of the photoconductor to form an electrostatic latent image on the photoconductor;

a plurality of developers to develop the electrostatic latent image formed on the photoconductor to form developing agent images on the photoconductor;

an intermediate transfer belt to which the developing agent images formed on the photoconductor are transferred;

a cleaning unit to come into contact with the intermediate transfer belt to remove developing agent wastes;

a first position recognition part formed at a front end of the intermediate transfer belt in a running direction of the intermediate transfer belt and a second position recognition part disposed at a rear end of the intermediate transfer belt, the first position recognition part and the second position recognition part being spaced apart from each other by a predetermined distance in a longitudinal direction of the intermediate transfer belt;

a position sensing unit to sense the first position recognition part and the second position recognition part;

a motor to rotate the intermediate transfer belt; and a controller to control the exposure unit based on a sensing signal generated when the position sensing unit senses the first position recognition part and velocity of the motor based on a sensing signal generated when the position sensing unit senses the second position recognition part, wherein the controller controls the velocity of the motor in an exposure section of second and subsequent colors to be lower than reference velocity of the motor in an exposure section of a first color to correct a color registration error between a developing agent image of the first color and developing agent images of the subsequent colors of a page caused by a change in rotational velocity of the intermediate transfer belt due to contact with the cleaning unit.

9. The multi pass type color image forming apparatus according to claim 8, wherein the controller controls the velocity of the motor in the exposure section of the second and subsequent colors to be reduced to velocity corresponding to Vm*(Tr/T_Y_i), where Vm is reference velocity of the motor, T_Y_i is one rotation time of the intermediate transfer belt in an exposure section of a first color of an i-th page, and Tr is an average value of one rotation time of the intermediate transfer belt in a warm-up section.

10. The multi pass type color image forming apparatus according to claim 8, wherein the controller controls the velocity of the motor in the exposure section of the second and subsequent colors to be lower than the reference velocity of the motor in the exposure section of the first color from a second page during consecutive printing of a plurality of pages.

11. The multi pass type color image forming apparatus according to claim 8, wherein, if one rotation time of the intermediate transfer belt rotated in the exposure section of the first color is greater than reference time, the controller controls the velocity of the motor in the exposure section of the second and subsequent colors to be lower than the reference velocity of the motor in the exposure section of the first color.

12. The multi pass type color image forming apparatus according to claim 11, wherein the reference time is an average value of one rotation time of the intermediate transfer belt in a warm-up section.

13. A control method of a multi pass type color image forming apparatus comprising:

irradiating a photoconductor at a reference exposure time point to form an electrostatic latent image of a first color; and irradiating the photoconductor in a state in which an exposure time of second and subsequent colors is controlled to be earlier than the reference exposure time point to correct a color registration error between a developing agent image of the first color and developing agent images of the subsequent colors of a page caused by a change in rotational velocity of the intermediate transfer belt due to contact with the cleaning unit.

* * * * *